United States Patent [19]

Kramer

[11] 3,994,142

[45] Nov. 30, 1976

[54] HEAT RECLAIM FOR REFRIGERATION SYSTEMS

[76] Inventor: Daniel E. Kramer, 2009 Woodland Drive, Yardley, Pa. 19067

[22] Filed: Jan. 12, 1976

[21] Appl. No.: 648,385

[52] U.S. Cl. ..... 62/117; 62/196 B; 62/238

[51] Int. Cl.[2] ..... F25B 5/00; F25B 41/00; F25B 27/02

[58] Field of Search ..... 62/117, 196 B, 238, 62/DIG. 17

[56] References Cited

UNITED STATES PATENTS

| | | | |
|---|---|---|---|
| 3,357,199 | 12/1967 | Harnish | 62/196 B |
| 3,370,438 | 2/1968 | Hopkinson | 62/196 B |
| 3,481,152 | 12/1969 | Seeley | 62/196 B |

*Primary Examiner*—Lloyd L. King
*Attorney, Agent, or Firm*—Daniel E. Kramer

[57] ABSTRACT

A refrigeration system which has two condensers located in different environments and intended for use alternately, a valve arrangement for determining which of the two condensers is to be operative for rejecting heat and which is to be inoperative, which includes control valves in the outlet conduit of each of the condensers arranged so that when one is open, the other is closed, and vice versa.

8 Claims, 5 Drawing Figures

HEAT RECLAIM FOR REFRIGERATION SYSTEMS

BACKGROUND OF THE INVENTION

1. Field of the Invention

This invention relates to the field of mechanical refrigeration and, more particularly, to those refrigeration systems which are equipped with two condensers, located in two different environments. One condenser is generally outdoors, where the heat abstracted by the refrigeration system from the evaporator plus the heat representing the mechanical energy added to the refrigerant vapor in the compressor is dissipated to the atmosphere, or alternately, is dissipated to a stream of water in an evaporative or water-cooled condenser. The second condenser is generally located in some environment which periodically requires heat which would otherwise have to be supplied by burning fossil fuel or by causing electricity to flow through resistance elements. The condenser, which is located in a position where its heat can be utilized, need not be used for heating air. It could be located in the tank of a hot water heater, or wherever the heat rejected by the condenser could be effectively utilized.

2. Description of the Prior Art

The use of two condensers in a mechanical refrigeration system, each located in different environments, is well known. Generally, the design of a system with two condensers is carried out in order to secure some saving in the cost of fuel to heat a space which is reasonably adjacent the space requiring refrigeration. The space requiring heating may be involved in a process requiring the warming of some medium or product, or it might be the warming of a space which must be maintained at a temperature above freezing or a space which must be maintained at a temperature habitable by humans or for some other purpose. By its very nature the space must require less heat than the refrigeration system can provide, either instantaneously or on a year-round basis. If the useful heat sink required more heat than a refrigeration system could provide at every point in time, there would be no need for two condensers. One condenser could be employed, located in the desired zone, and the refrigeration system could pump its heat to that condenser at all times the compresser was in operation. This invention, and the prior art related to it, pertains to the situation where the heating load is at some time less than the heat output which can be generated by the refrigeration system. At some time, the heat generated by the system must be shifted to some sink or environment where its dissipation will not cause any inconvenience or any malfunctioning of the system itself. Having established the need for two condensers, where partial heat reclamation is to be achieved, engineers turned their thoughts in the past to valving systems and controls which would function in a troublefree fashion which would not interfere with normal refrigeration system operation and which, under instruction from some control, would deliver heat first to one condenser, than to the second, alternately.

Since the medium to be controlled was hot refrigerant vapor, the obvious control system required the location of valves, generally automatic, and, most frequently, of the electric solenoid type, in the vapor or hot gas line to each of the condensers These were so arranged that when one opened, the other closed, so that the gas flow from the compressor was to either one condenser or to the other. Selection of condensers was generally determined by a control located in the environment which required or could tolerate the least heat, so that at all times that that environment did not require heat, the heat generated by the system was rejected to the other condenser.

On only the briefest trial of this control arrangement, the refrigeration engineers discovered that the inoperative condenser with its inlet closed quickly filled with liquid refrigerant through its outlet connection. The result was that substantial amounts of refrigerant had to be added to the system sufficient to fill the inoperative condenser. If the two condensers were not of the same size, then enough refrigerant had to be added to the system to fill the larger of the two.

Refrigeration engineers considered the need for the addition of substantial quantities of extra refrigerant a disadvantage. In an effort to reduce the amount of this extra refrigerant required, or eliminate the extra portion of refrigerant entirely, they provided a check valve at the outlet of each of the two condenser circuits. Their logic was that the extra valve would, during the period a condenser was inoperative, prevent the inoperative condenser from filling with liquid refrigerant. These innovators were blessed with initial success, because, on changeover from heat rejection in one condenser to heat rejection in the other, the inoperative condenser was isolated by the closing of its inlet control solenoid valve and the simultaneous closing of its outlet check valve. The glow of success of these innovators, however, was short-lived. Although some check valves and solenoid valves are absolutely bubble-tight, that is, do not allow the adverse flow of any amount of vapor at all over substantial periods of time, most refrigeration valves are not so thoroughly leak-tight and do allow the flow of small quantities of refrigerant through their closed ports to the extent of an ounce or more of refrigerant flow per hour. Where the mode of operation requires one condenser to be operative for long periods, for instance, 4 to 6 months, and the other condenser to be operative for equally long periods, it is easy to see that the valves used to isolate the inoperative circuit must have an unusually high barrier against leakage; otherwise, leakage rates of even a few ounces a day would allow the entire refrigerant charge to migrate into the unused condenser, causing a shortage of refrigerant in the refrigerating section of the system, with the resultant lack of refrigeration. To cope with this problem, the resourceful refrigeration engineers developed a series of curative measures. They either vented the unused circuit to the low side, so that all of the refrigerant contained in it and all the refrigerant that might conceivably leak into it at some future time was drained away in vapor form and vented to the low side, or, alternately, through the use of a time clock, they caused the control valve of the unused circuit to open periodically, for instance, once every 6 hours or once every 24 hours, so that any refrigerant which had been accumulated in it would be pushed out into the main refrigerating circuit and only the residual minimum operating charge would be left in it. Both of these corrective measures have been widely utilized. The timer system is favored by some engineers because it does not add any refrigerant control valves to the system. The evacuation technique is favored by other refrigeration engineers because the inoperative circuit is completely purged of refrigerant and its internal pressure is reduced to that of the low side.

BRIEF SUMMARY OF THE INVENTION

Unfortunately, though both of these heat reclaim techniques can and are presently being used, they are prone to substantial failure rates, either through failure of the timer, failure of the venting solenoid, failure of the condenser outlet check valve, or failure of the hot gas solenoid used to control the flow of the hot refrigerant vapor into the alternative condensers. When either of these evacuation systems fail to function correctly, the inoperative condenser, fills with liquid refrigerant, depleting the main refrigeration circuit of its essential fluid. This causes the main refrigeration circuit to fail to refrigerate. This failure to refrigerate frequently causes the loss of foodstuffs in open refrigerated display cases or the cessation of processing in manufacturing environments. It is the object of this invention, therefore, to provide a control system for dual or multiple condensers used in a refrigeration system in a heat reclaim arrangement, which achieves maximum reliability, which does not require evacuation of the inoperative condenser, which requires as few as a single control valve and a slave control valve by contrast with the 4 to 6 valves required by the earlier systems, and which subjects the control valves to liquid flow only so that there is no tendency for their inner parts to be distorted, burned, or otherwise hampered in their operation, or deteriorated by the high gas temperatures sometimes emitted by refrigeration compressors.

The invention contemplates the control of refrigerant flow to the alternate condensers by the installation of control valves at the outlet of these condensers. This apparently simple change achieves the following desirable effects:

a. It subjects the control valves only to the cool liquid refrigerant, leaving either condenser, instead of the hot gas entering it.
b. It allows the control valves to be much smaller in size than those control valves used formerly in the discharge line.
c. Since this control scheme contemplates the intentional flooding of the unused condenser with liquid refrigerant, there is no mechanism necessary or intended for the evacuation of refrigerant from the unused condenser. Instead, it is contemplated that the installer, having been preadvised and forewarned about the need for extra refrigerant in the system, will charge the necessary refrigerant into the system on initial start-up, the extra cost of this refrigerant being offset by the saving in the control valves necessary to achieve the evacuation of the inoperative condenser in the systems of the prior art and the increased operating reliability which today, with the high cost of food, is of extreme importance in the maintenance of an economical food-dispensing operation.

Figure 1:
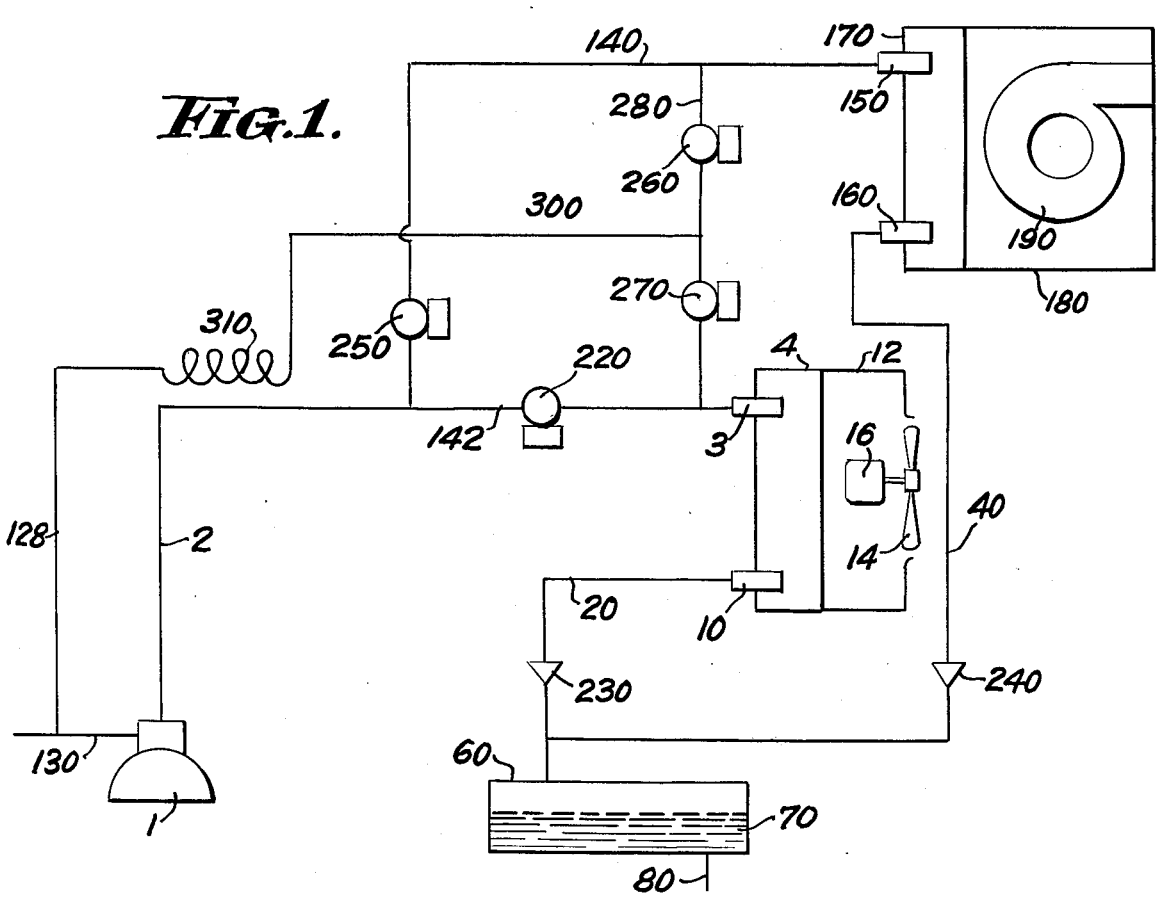
FIG. 1 is a schematic piping diagram of a compression-type refrigeration system which includes two condensers in different environments intended for alternate operation with a valve control means for selecting between the condensers which has been widely used and is well known in the prior art. It includes discharge solenoid valves in the inlet conduit to each condenser and outlet check valves at the outlet of each condenser.

DETAILED DESCRIPTION OF THE DRAWINGS:

FIG. 1 is a schematic piping diagram of a compression-type refrigeration high side, not exhibiting the principle of this invention, which includes two condensers, each located in different environments, with valve control means for selecting which condenser is to be operative to reject heat absorbed by the system evaporator and which is to be inoperative for this purpose. Compressor 1 receives its vapor for compression from suction line 130 and discharges the vapor at higher pressure to discharge line 2. Discharge line 2 divides into two valve controlled branches. Branch 140 is controlled by valve 250 and serves to convey vapor to condenser 170 via its inlet 150 under conditions when its control valve 250 is open. Vapor is condensed to a liquid in condenser 170 and is discharged through its outlet fitting 160 to liquid outlet line 40 by which it is conveyed to receiver 60 via an outlet check valve 240. In the receiver 60 the liquid refrigerant collects in a pool 70 and is drawn as required through liquid line 80 to an expansion valve and evaporator which are not shown. In the evaporator liquid refrigerant is vaporized while it is performing its cooling function and is returned to the compressor via suction line 130. The other branch 142 of discharge line 2 is controlled by solenoid valve 220. When that valve is open, its corresponding valve 250, controlling the flow in branch 140, is closed, and vice versa. During periods when valve 220 is open and flow allowed to occur in discharge branch 142, the discharge vapor enters condenser coil 4 through its inlet 3 and is condensed therein to a liquid. The liquid is discharged via the condenser outlet connection 10 to condenser outlet liquid conduit 20 from which it is conveyed to the receiver 60 via outlet check valve 230. In the receiver 60 the refrigerant collects in a pool 70 from which it is withdrawn as required via liquid line 80 to an expansion valve and evaporator not shown. In the evaporator the liquid refrigerant is evaporated while it performs its cooling function and the resulting vapor is conveyed back to the compressor for recompression via suction line 130. It is entirely likely that conditions will arise where solenoid valve 220 will be open for long periods of time, for instance for months, while discharge line solenoid 250 will be closed for equally long periods of time. During these periods, the pressure in condenser 4 will be high whenever compressor 1 is operating, but the pressure in condenser 170 will be considerably lower and will correspond to the equilibrium pressure of the refrigerant at the atmospheric temperature which surrounds the condenser coil 170. Under these conditions, there will be a pressure differential tending to cause flow through solenoid valve 250 in its forward direction and through check valve 240 in its backward direction. If these valves were perfectly tight, then no such flow could occur. Unfortunately, practical valves do have a small, though definite, leakage rate, frequently on the order of ounces per hour. Though this amount of leakage is small in terms of net refrigeration effect and would cause no harmful results were the valves applied as liquid solenoids or in some way where the leakage would not have some overall permanent effect, in the present application, leakage through either solenoid valve 250 or check valve 240 causes essentially permanent loss of that leaked refrigerant to the operating portion of the system. Once the refrigerant has traversed either of those valves it simply accumulates in the volume comprising discharge line 140, condenser coil 170 and outlet conduit 40, and is not available for refrigeration purposes to the operative portion of the system. The result is that the pool of refrigerant 70 in the receiver 60 is gradually depleted and eventually reduced to nothing, so that the refrigerating system runs out of refrigerant and becomes inoperative. In order to cope with this situation, two corrective measures have been applied. The first, not shown, is the application of a timer which periodically causes the operative conditions of valve 220 and 250 to reverse from whatever condition they were in previously. For instance, under the condition previously described, where valve 220 is continuously open and valve 250 continuously closed, the timer would cause valve 220 to close and valve 250 to open for a period of perhaps 5 minutes out of each 12 hours. During this period of time, any refrigerant which had collected in discharge line 140, condenser 170 or liquid outlet conduit 40, would be discharged into the receiver and made available for refrigeration use when the 5-minute flush-out period had been terminated. By contrast, if the operating condition was such that solenoid valve 250 was continuously open, and valve 220 was continuously closed, the timer would temporarily close valve 250 and open valve 220 to flush from condenser 4 and liquid outlet conduit 20 any accumulated refrigerant.

A second means for coping with the minute leakage situation is the installation, as shown in FIG. 1, of a pair of valve controlled conduits so arranged that any refrigerant which collects in the unused condenser section will be bled off to the low side. In the figure these comprise conduit 280, controlled by solenoid valve 260, and conduit 290, controlled by solenoid valve 270. These two conduits combine at the outlet of their respective solenoids into conduit 300, which serves to deliver any vented vapor to heat exchanger 310, which is in heat exchange relationship with the main discharge line 2 of the system. Heat exchanger 310 is connected at its other end to suction conduit 130 by way of conduit 128. Under conditions when discharge solenoid 220 is open, and the system heat is being discharged at condenser coil 4, and simultaneously, discharge solenoid 250 is closed, then vent solenoid 260 would be open and vent solenoid 270 would be closed. In this mode, any vapor which resided in the condenser portion 170 and its related piping would be discharged through conduit 300 and heat exchanger 310 into suction line 130. The heat exchanger 310 is provided against the possibility that liquid refrigerant which normally resides in condenser 170 and liquid outlet conduit 40 during periods of normal operation when solenoid valve 250 is open, would flash back as liquid through vent conduit 280 and would be delivered as liquid refrigerant to the compressor inlet which might damage it.

In the alternate mode of operation, when discharge solenoid 250 is open, and discharge solenoid 220 is closed, allowing flow of refrigerant vapor to condenser coil 170, so that the full system heat rejection occurs at the coil, vent solenoid 270 would be open and vent solenoid 260 would be closed, allowing collected liquid and vaporous refrigerant in condenser 4 and its associated piping to be bled off to the low side, leaving that portion of the system essentially empty of refrigerant and barring the possibility of any undue collection of refrigerant in it which might inpede the operation of the refrigeration system. Note that solenoid valves 220 and 250 are both subject to the flow of hot discharge vapor for long periods of time. Valves subjected to discharge vapor under these conditions frequently tend to have shorter lives and exhibit greater propensity to require maintenance than valves used in cooler regimes. In addition, these valves must be sized large enough to convey the large volumes of discharge vapor without unreasonable pressure drop. Finally, the extra mechanism and piping comprising the venting schemes must be applied in order to make the system operative.

Figure 2:
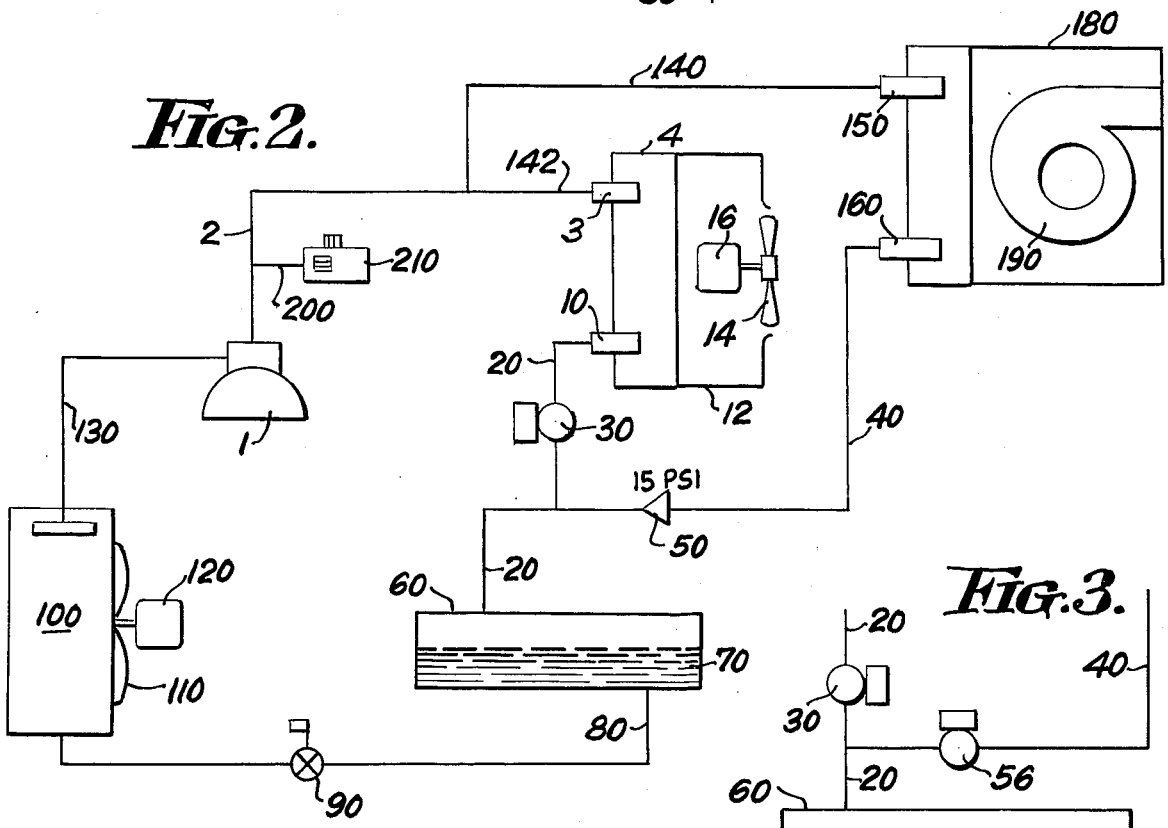
FIG. 2 is a schematic piping diagram of a compression-type refrigeration system including two condensers intended for alternate use, embodying a principle of this invention where the control valves controlling the selection of the operative condenser are installed at the condenser outlet and one valve is a master, the second is a slave.

FIG. 2 shows essentially the same major refrigeration components but incorporated with a control system incorporating a principle of this invention. In FIG. 2 compressor 1 discharges to discharge line 2 which divides into two branch discharge lines, 140 connecting to condenser 170, and 142 connecting to condenser 4. Condenser 170 discharges to receiver 60 via its liquid outlet conduit 40. Condenser 4 discharges to receiver 60 via its outlet conduit 20. The condensed liquid collects as a reserve pool 70 in receiver 60 and is conveyed via liquid line 80, as required, to expansion valve 90 for evaporation in evaporator 100 and eventual return as a vapor to the compressor via suction line 130.

When it is desired to reject all of the system heat at condenser 4, solenoid valve 30 is opened. In that condition, the pressure drop through branch discharge line 142, condenser 4, condenser outlet contuit 20 and condenser outlet solenoid 30 is typically 8 to 10 PSI. Under these conditions, check valve 50, which is in the outlet conduit of condenser 170, does not open because the pressure drop across it of 10 PSI is not enough to push its piston off its seat, since the piston is biased toward its seat by a spring which is selected to prevent the piston from moving from its seat until the pressure drop across it has reached at least 15 PSI. In this regime, with solenoid 30 open, vapor flow can occur to both condenser 4 and condenser 170, since there are no valves in the respective discharge conduits 142 or 140 to prevent this flow. Refrigerant which flows to condenser 4 condenses to a liquid and flows via open solenoid valve 30 to the receiver 60. However, refrigerant which flows through discharge branch conduit 140 to condenser 170 condenses therein but cannot traverse closed check valve 50 and therefore accumulates until liquid outlet conduit 40 is filled and the condenser coil 170 is completely filled along with any portion of the discharge line 140, which does not self-drain back into main discharge line 2. Note that condenser 170 has been made inoperative, not by closing off its discharge conduit 140 to the flow of suction vapor, but rather by preventing the egress of refrigerant from the condenser and allowing it to become completely filled with refrigerant to the extent that no more refrigerant can condense in it. At that point, condenser 170 becomes inoperative as a condenser and ceases to be able to deliver heat to an air stream traversing it despite the fact that its inlet conduit 140 is completely open to the main discharge line. At a time when the thermostatic or other control dictates that heating is required at condenser coil 170 and no longer required at condenser 4, solenoid valve 30 will close. At that moment, refrigerant will begin to collect in condenser 4 and, simultaneously, sufficient pressure differential will occur across check valve 50 to cause it to push open, allowing all the accumulated liquid, which had been stored in condenser coil 170 and its liquid outlet conduit 40, to flow to the receiver where gradually it will be drawn out by the expansion valve, evaporated by the evaporator, compressed by the compressor and used to fill the newly inoperative condenser 4. When condenser 4 has become completely filled, it will no longer be able to operate as a heat transfer device and the full flow of refrigerant discharged by the compressor 1 will be true discharge line 40 to condenser 170 and the total heat rejection of the system will be placed at condenser 170. Solenoid valve 30 is of the type which is open when its solenoid coil is deenergized.

Condenser 4 is generally located outside, subject to ambient conditions. Condenser 170 is generally located inside, where the heat rejected by it can be used to warm some interior occupied or processing space. Frequently, blower section 180 and blower 190 are part of an overall heating and air conditioning system. It has been found that these air circulation systems associated with the air conditioning are subject to sharp reduction in air flows under conditions of poor maintenance. For instance, air filters, which are generally part of an air conditioning system, can clog up, sharply reducing the air flow both over the air conditioning cooling coil and over condenser coil 170; or the fan motor, now shown, driving blower 190, can fail; or the belt drive break; or all the dampers be closed by operating personnel in an effort to reduce apparent draftiness. All of these situations could reduce air flow over condenser coil 170 below that required to perform the required full condensing job. In that situation, the condensing pressure experienced by compressor 1 might become excessive. To provide a low cost safety which would ensure continued refrigeration, even under conditions where the air flow over the heat reclaim condenser failed, pressure switch 210 is provided, connected to the compressor discharge line or any other spot in the high side by a small bore conduit 200. This pressure switch is adjusted to a pressure below that pressure at which the safety device would cause compressor 1 to stop and above that pressure which is expected to be the maximum normal operating pressure which would occur when condenser 170 is being used to reject heat to an occupied or processing space. Should, for any reason, the air flow over condenser 170 drop to the danger point, pressure in the high side will rise to the setting of pressure switch 210, which will then operate to open valve 30 (and, in FIG. 3 and 4, close valve 56) restoring condenser 4 as the main condenser and disabling condenser 170 as the main condenser. In this way there will be no cessation of refrigeration, even though condenser 170 fails to perform adequately as a heat reclaim condenser, and the main function of the refrigerating system, which is to refrigerate its evaporator, will continue unimpeded.

Figure 3:
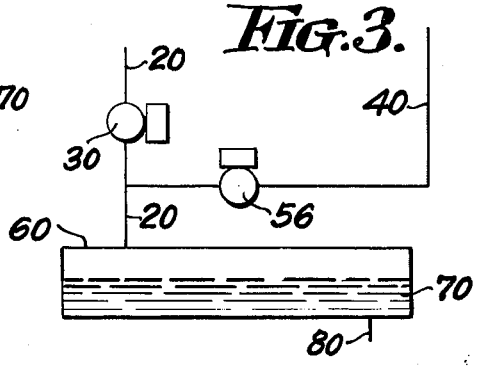
FIG. 3 shows a section of the piping diagram of FIG. 2 where both valves are masters.

FIG. 3 shows the portion of the liquid conduits 40 and 20 of the two condensers 4 and 70 of FIG. 2 but where check valve 50 with its 15 PSI spring load has been replaced by solenoid 56, which is designed to open when its solenoid coil is energized. When heat is required at condenser 4 and no heat at condenser 170, then solenoid 30 will be open and solenoid 56 will be closed by the removal of electrical power from their coils. When heat is no longer required at condenser 4 but is required at condenser 170, then solenoid valve 30 will be closed and solenoid valve 56 will be open by the application of electrical power to both their solenoid coils. The unused condenser will in each case be associated with its own closed outlet solenoid valve. In all other respects, the operation of the system and of the two condensers will be as explained in FIG. 2, that is, the unused condenser will fill completely with liquid refrigerant and thereupon become inoperative as a heat transfer device.

Figure 4:
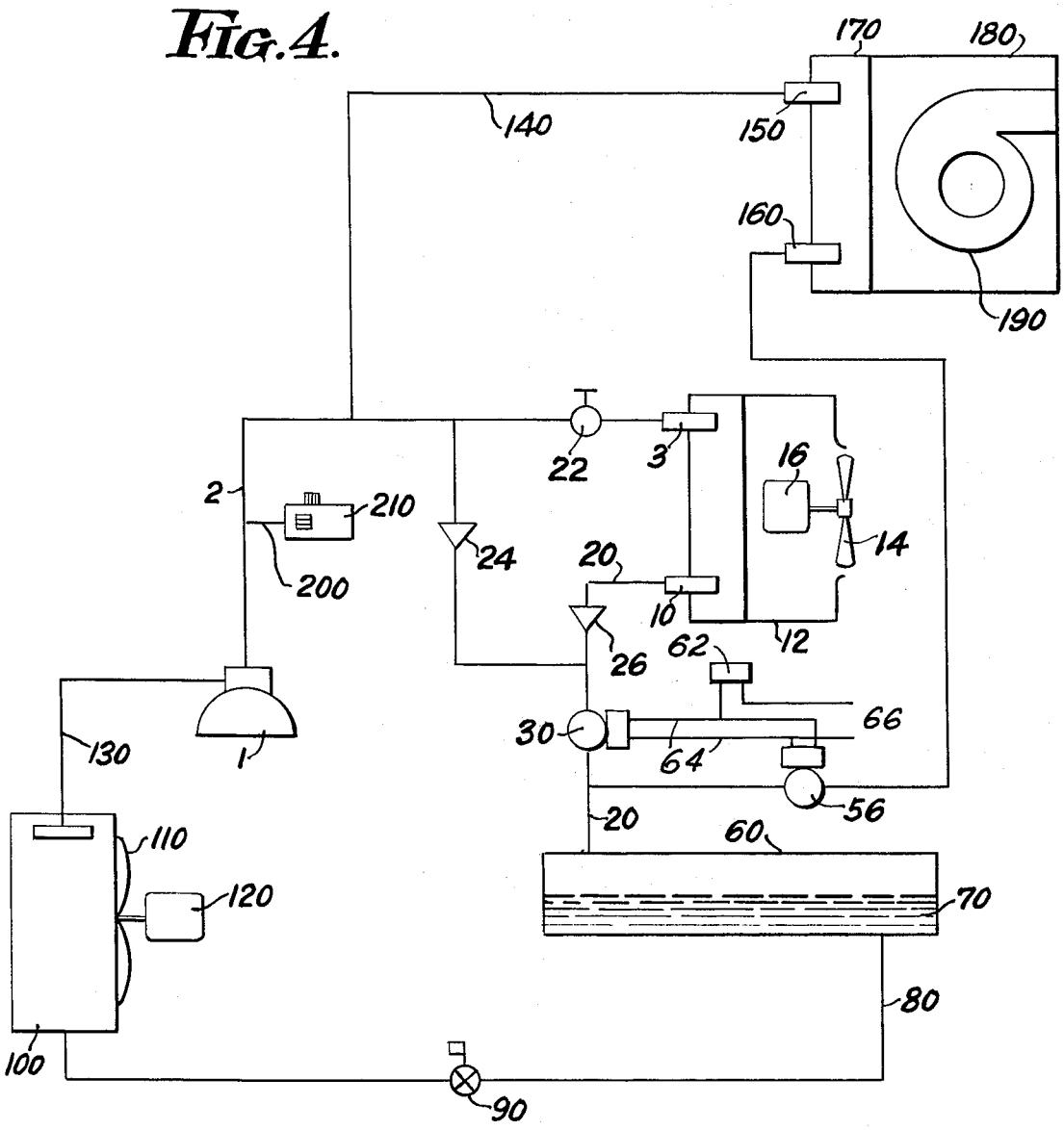
FIG. 4 is a schematic piping diagram of a compression-type refrigeration system employing two condensers intended for alternate use which embodies the principle of this invention and includes valves for selecting which of the condensers will operate and which will be inoperative; and further includes a condenser capacity control for use with one of the two condensers.

FIG. 4 is the schematic piping diagram of a system using the principle of the invention intended for use in the event condenser 4, which is located outdoors, subject to summer and winter ambients, is expected to operate during cold winter weather. In that situation some control over the condensing capacity of condenser 4 must be provided. Condenser 4 is located outdoors, subject to all ambients, and condenser 170 is located indoors in a location where its heat can be utilized in place of the burning of carbonaceous fuels, such as in the interior of a warehouse or in a duct system supplying heat and air conditioning to an office space. In this case the designer is aware that the heat which could be rejected by the refrigeration system at condenser coil 170 is much greater than that required to do an adequate heating job of the interior space served by that condenser. Therefore, even in the coldest weather, or when the greatest amount of heat is required, the space would overheat if the condenser 170 were to dissipate its heat continuously. Therefore, control thermostat 62 which actuates solenoid valves 30 and 56 from power source 66, through connecting wire 64, opening one valve and closing the other, alternately, would at times be expected to close valve 56 and open valve 30 during periods when condenser 4 is exposed to very low ambient. In order to assure safisfactory performance of the refrigeration system under these conditions, a condenser capacity control, comprising valves 22, 24 and 26, is provided in the condenser circuit of condenser 4. Typically, valve 22 is an inlet regulator which is set to close when the pressure at its inlet drops below a preset value. Valve 24 is a spring-loaded check valve whose spring is designed to prevent the valve from opening until the pressure drop across it exceeds 15 PSI. Valve 26 is an ordinary check valve, intended to allow flow from the condenser to the receiver and to prevent reverse flow. Under conditions when valve 30 is closed and valve 56 is open, the entire condenser 4 will be filled with liquid refrigerant as will the piping associated with it and therefore the capacity of condenser 4 will be zero and the capacity control will have no effect, regardless of the pressure to which it is exposed. However, under conditions where valve 56 is closed and valve 30 is open, the condenser capacity control may be called on to act if the air temperature drawn over condenser coil 4 by fan 14 which is driven by motor 16 is lower than about 65° or 70°. In that event, the pressure at the inlet of valve 22 will drop below the valve setting and the valve will begin to throttle towards its closed position. This throttling creates a pressure drop across valve 22, which, in turn, is transferred and reflected in an increased pressure drop across valve 24. When that pressure drop across valve 24, which is directly caused by the increased throttling of valve 22 in its effort to maintain its inlet pressure at or above its predetermined setting, increases to 15 PSI, then valve 24 will push open and some discharge vapor will flow through valve 24 into the receiver 60, causing a warming of the cold liquid leaving condenser 4, with the resultant flooding of the condenser. Pressure switch 210 is connected to close valve 56 and open valve 30, in that situation that the high side pressure becomes excessive during the period that condenser 4 is inoperative and condenser 170 is operative, all as explained in connection with the operation of FIGS. 2 and 3. Though valve 30 is described as a normally open solenoid (open with coil deenergized) and valve 56 as a normally closed solenoid (closed with coil deenergized) so that with the coils connected electrically in parallel one is always open and one is always closed, it is also contemplated that the solenoids both be of the same type, either both normally open or both normally closed and the opposite conditions of the two valves achieved by alternately energizing each coil while deenergizing the other coil.

Figure 5:
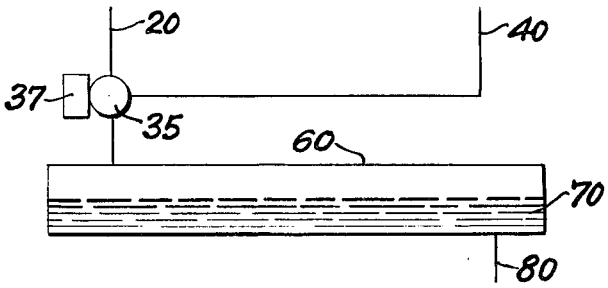
FIG. 5 shows a section of the piping diagram of FIG. 4 where the alternating flow is achieved by a 3-way valve.

FIG. 5 shows both condenser outlet conduits 20 and 40 where the alternating flow is achieved by 3-way valve 35, which is activated by its coil 37 to allow flow through conduit 20 while simultaneously preventing flow through conduit 40 and vice versa.

The portion of all systems subjected to pressure equal to or higher than the pressure at the inlet of expansion valve 90 is the "high side" of the system and includes the discharge side of the compressor, all discharge piping, both condensers and all liquid containers and piping up to and including the expansion valve.

I claim:

1. An improved compression type refrigeration system including a conduit connected expansion device, evaporator, a compressor having a discharge port and at least a first and a second condenser said first condenser having an inlet and an outlet, said second condenser having an inlet and an outlet, discharge conduit means connecting the compressor discharge port with the first and second condenser inlets; a first liquid conduit connected at one end to the first condenser outlet, a second liquid conduit connected to the second condenser outlet, wherein the improvement comprises first valve means located in said first liquid conduit, said valve means having an open position for allowing flow from said first condenser and a closed position for preventing flow from said first condenser and for causing said first condenser to fill with liquid refrigerant; second valve means located in second liquid conduit, said second valve means having an open position for allowing flow from said second condenser and a closed position for preventing flow from said second condenser and for causing said second condenser to fill with liquid refrigerant and control means acting to open the second valve means when the first valve means is closed and acting to close the second valve means when the first valve means is open.

2. A refrigeration system as in claim 1 where the first and second valve means are solenoid valves.

3. A system as in claim 2 where one solenoid valve closes when its coil is energized and the other solenoid valve opens when its coil is energized.

4. A refrigeration system as in claim 1 which includes a capacity control for partially reducing the capacity of at least one of the condensers.

5. A system as in claim 1 which includes pressure actuated means which acts to reverse the open-closed conditions of the first and second valve means when the high side pressure exceeds a preset value.

6. An improved compression type refrigeration system including a compressor having a discharge port, a first condenser having an inlet and an outlet, a second condenser having an inlet and an outlet, discharge conduit means connecting the compressor discharge port with the first and second condenser inlets; a first liquid conduit connected at one end to the first condenser outlet, a second liquid conduit connected to the second condenser outlet, wherein the improvement comprises first valve means located in said first liquid conduit, said valve means having open and closed positions for allowing and preventing flow in said first liquid outlet conduit, spring-loaded check valve means located in second liquid conduit and control means acting to open and close said first valve means.

7. An improved compression type refrigeration system including a compressor having a discharge port, a first condenser having an inlet and an outlet, a second condenser having an inlet and an outlet, discharge conduit means connecting the compressor discharge port with the first and second condenser inlets; a first liquid conduit connected at one end to the first condenser outlet, a second liquid conduit connected to the second condenser outlet, wherein the improvement comprises valve means having a first inlet, a second inlet and an outlet, said first inlet connected to the first condenser outlet, said second inlet connected to said second condenser outlet, and control means for alternately A. allowing flow from the first inlet to the outlet and preventing flow from the second inlet to the outlet, and B. allowing flow from the second inlet to the outlet and preventing flow from the first inlet to the outlet.

8. An improved method of controlling refrigerant vapor flow to multiple condensers in a refrigeration system comprising the steps of;

1.

a. allowing refrigerant outflow from a first condenser;

b. simultaneously preventing refrigerant outflow from a second condenser; whereby liquid refrigerant is caused to accumulate in the second condenser, thereby preventing further access to and condensation of refrigerant vapor therein; and alternately,

2.

a. preventing refrigerant outflow from said first condenser b. allowing refrigerant outflow from said second condenser; whereby liquid refrigerant is caused to accumulate in the first condenser, preventing further access to and condensation of refrigerant vapor therein.

* * * * *